United States Patent [19]

Auerbach et al.

[11] 4,323,051

[45] Apr. 6, 1982

[54] COAL-BURNING FURNACE OR BOILER

[75] Inventors: Les M. Auerbach, Madison; William F. Ricker, Guilford, both of Conn.

[73] Assignee: Old King Coal, Ltd., Madison, Conn.

[21] Appl. No.: 166,775

[22] Filed: Jul. 8, 1980

[51] Int. Cl.[3] ..... F24C 1/14; F24H 9/14

[52] U.S. Cl. ..... 126/77; 126/99 D; 126/101; 126/119

[58] Field of Search ..... 126/99 D, 119, 112, 126/77, 101, 15 R, 15 A, 99 A, 109

[56] References Cited

U.S. PATENT DOCUMENTS

| | | | |
|---|---|---|---|
| 292,537 | 1/1884 | Condit | 126/119 |
| 925,570 | 6/1909 | Eckert | 126/112 |
| 1,815,882 | 7/1931 | Davidson | 126/101 |
| 2,345,519 | 3/1944 | Wingert | 126/77 |
| 2,417,138 | 3/1947 | Stenzy | 126/77 |
| 4,136,662 | 1/1979 | Willson | 126/77 |
| 4,140,101 | 2/1979 | Glover | 126/77 |
| 4,154,212 | 5/1979 | Wilkinson | 126/77 |
| 4,190,038 | 2/1980 | Heitland et al. | 126/445 |
| 4,200,086 | 4/1980 | Kolb | 126/77 |
| 4,201,185 | 5/1980 | Black | 126/77 |

OTHER PUBLICATIONS

Woodstove Directory, 1980, pp. 21, 47, 70, 85.

*Primary Examiner*—Daniel J. O'Connor
*Attorney, Agent, or Firm*—Paul J. Lerner

[57] ABSTRACT

A coal-burning boiler wherein primary air is admitted in the boiler front, below the grate, and secondary air is admitted in the rear of the boiler, below a box-like baffle member. The baffle member is disposed parallel to the grate and divides the boiler into upper and lower chambers communicating adjacent the boiler front, whereby the streams of primary and secondary air merge to flow over both the lower and upper surfaces of the baffle prior to exiting the boiler by way of a stack at the rear thereof. Secondary combustion thus occurs along the lower or under surface of the baffle member. The baffle is subdivided by parallel, longitudinally extending members so as to define a single, continuous fluid flow channel, whereby water may be efficiently heated by passage therethrough. The boiler is formed of upper and lower halves bolted together along mating peripheral flanges.

4 Claims, 4 Drawing Figures

COAL-BURNING FURNACE OR BOILER

BACKGROUND AND SUMMARY OF THE INVENTION

The present invention relates to coal-burning furnaces and especially to those, termed boilers, adapted for heating water or similar fluids flowing therethrough.

With the rapidly rising cost of fuel oil, natural gas and electricity, attention is increasingly being directed to the use of coal and wood for home heating. Unfortunately, there is a general lack of understanding that wood and coal differ significantly and that the efficient use of coal requires a furnace properly designed therefor.

The burning of coal, unlike the burning of wood, is necessarily a two-step process involving primary combustion of the coal, during which combustible gases are produced, and secondary combustion or combustion of the gaseous products of the primary combustion. Air involved in the primary combustion is known as primary air, while air involved in the secondary combustion is known as secondary air.

It is known, in the prior art, to provide for the combustion of these combustible gases, generally through the addition of controlled amounts of secondary air. Existing furnaces, however, are often designed to accept both coal and wood, which yield vastly different amounts of combustible gas, and, therefore, are not optimally efficient in the use of either fuel. Further, such furnaces are generally intended to maximize heat transfer to the surrounding room air, by conduction and radiation, rather than to a working fluid, such as water, passing through the furnace. Thus, these furnaces are not adapted for use in a central heating system, especially such a system integrated with a domestic hot water system.

Finally, existing furnaces are seen to suffer in that they generally include a firebox comprising a single casting or welded assemblage, of tremendous weight, which renders transportation and installation of the furnace difficult and costly.

It is, therefore, a primary object of the present invention to provide a coal-burning furnace having increased efficiency. This is accomplished, in general, by a furnace wherein gases, generated by the primary combustion of the coal, are collected beneath a transverse baffle member and there burned, the hot burned gases then being passed around the baffle before exiting the furnace. More specifically, primary air is admitted through the front of the furnace, below the grate, while secondary air is admitted through the rear of the furnace, immediately below the baffle member.

It is another object to provide a coal-burning boiler adapted for use in an integrated central heating and domestic hot water system. This is accomplished, in general, by the provision of a heat transfer member adapted for the efficient heating of water passed therethrough. More specifically, the previously mentioned baffle member may advantageously comprise a pair of parallel plates and a plurality of parallel channel wall members extending perpendicularly therebetween, the channel wall members being alternately longitudinally offset, each contacting but one of a pair of end walls, so as to form a continuous fluid flow channel for passage of a stream of water through the boiler.

It is yet another object to provide a coal-burning furnace which may be readily transported to the installation site and there installed without the need for heavy lifting equipment. This is accomplished by a furnace comprising relatively readily transportable upper and lower firebox halves having mating, outwardly turned, flanges. The flanges, which provide the necessary firebox rigidity, are bolted together, in facing relation, to assemble the furnace at the place of installation.

It is still another object to provide a furnace of the aforementioned character and kind which is simple and economical of fabrication.

BRIEF DESCRIPTION OF THE DRAWING

The above and other objects, as may hereinafter appear, of the present invention may be more clearly understood by reference to the following description of the preferred embodiment, the claims, and the drawing, wherein:

DESCRIPTION OF THE PREFERRED EMBODIMENT

Figure 1:
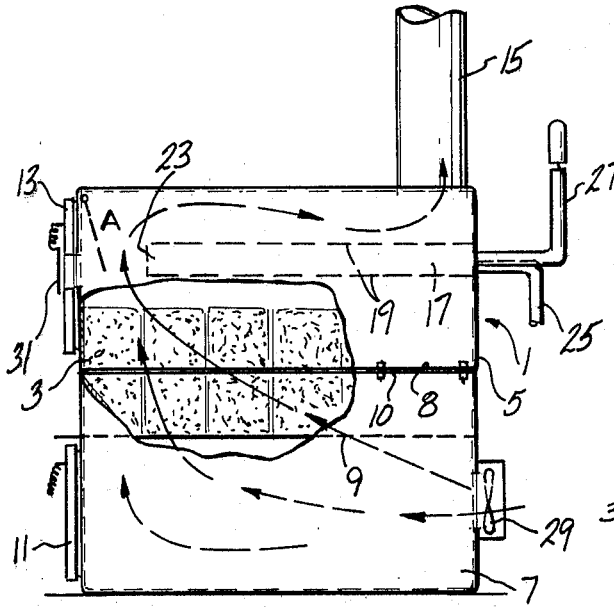
FIG. 1 is a side view, partly broken away, of a first developmental model of the boiler of the present invention.

Turning now to the drawing, there is shown, in FIG. 1, a coal-burning boiler comprising a right parallelepiped firebox 1, formed of welded steel plates and internally lined with firebrick 3, assembled from upper and lower firebox halves 5 and 7 respectively, having mating, outwardly turned, rigidifying flanges 8 and 10 respectively, which are bolted together in facing relation. It is to be noted that this boiler is adapted to sit directly on a flat, fireproof surface, such as a concrete floor, and that firebox 1 does not include a bottom wall. A grate 9, disposed within firebox 1, is adapted to support a bed of coal to be burned. The front wall of firebox 1 is provided with an ash removal door 11, below the level of grate 9, and a loading door 13, above the level of grate 9. An exhaust pipe 15 enters the top of firebox 1, proximate the rear thereof.

Figure 4:
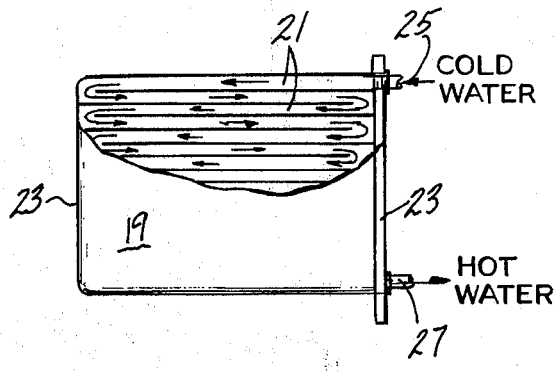
FIG. 4 is a top plane view, partly broken away, of the heat transfer member of FIGS. 1–3.

A baffle member 17 is disposed within firebox 1, above and parallel to grate 9, and consists of a heat transfer member comprising a pair of parallel plates 19, a plurality of parallel channel wall members 21 extending perpendicularly therebetween, and a pair of parallel end walls 23. Baffle member 17 completely traverses firebox 1, from side to side, and extends forwardly from the rear wall thereof, leaving a gas passage area A proximate the front of firebox 1. As best seen in FIG. 4, channel wall members 21 are alternately longitudinally offset, each contacting but one of end walls 23, so as to form a continous fluid flow channel for the passage of a stream of water through the boiler. Water inlet and outlet connections, 25 and 27 respectively, disposed on the rear wall of the boiler, are connected to the ends of the flow channel of the heat transfer member.

Primary air is provided by a motor-driven fan 29 on the rear wall of firebox 1, below the level of grate 9, while secondary air is controllably admitted through an adjustable sliding plate vent 31 on loading door 13, approximately at the level of baffle member 17.

Investigation and experimentation with this boiler, however, revealed basic shortcomings. Firstly, the lack of a firebox bottom wall resulted in leakage of primary air, whereby precise control was impossible. Secondly, and more importantly, the primary air, forcefully introduced under the influence of fan 29, tended to flow (as indicated by the arrows) toward the front of firebox 1 before rising through grate 9, whereby combustion of the coal was uneven, with the coal near the rear of firebox 1 remaining largely unburned. This uneven pattern of coal burning is especially significant in its effect on the distribution of the combustible gases produced by the primary combustion of the coal. It was desired that these gases be evenly distributed along the underside of the heat transfer member, and there burned, so as to maximize the transfer of heat to the water flowing therethrough. It was discovered, however, that the gases were primarily produced near the front of firebox 1, and that gases produced nearer the rear of the firebox 1 were drawn forwardly, by the stream of air created by fan 29, whereby the bulk of the combustible gases tended to collect in passage area A, rather than under the heat transfer member.

Figure 2:
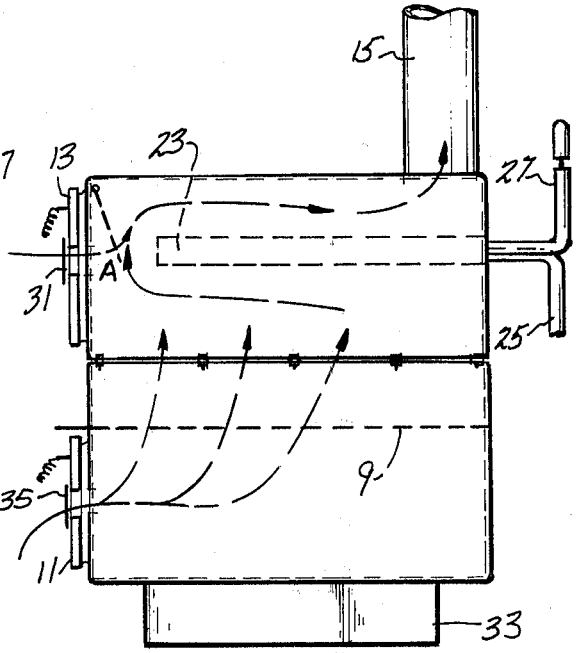
FIG. 2 is a side view, similar to FIG. 1, of a second developmental model of the boiler of the present invention.

In an effort to overcome these shortcomings, the initial developmental model of the boiler was modified, as seen in FIG. 2, by the addition of a bottom wall to firebox 1, the boiler now standing on a base 33 formed of concrete blocks. Further, fan 29 has been removed and the opening therefor has been sealed. Primary air is now controllably admitted through an adjustable sliding plate vent 35 in ash removal door 11.

Investigation and experimentation with this second boiler revealed a significant improvement over the previous one. Primary air flowing up through grate 9 is more evenly distributed. However, it was discovered that the bulk of the combustible gases were flowing forwardly, along the underside of the heat transfer member, without burning, and that the bulk of the secondary combustion was occurring in gas passage area A. Thus, heat transfer efficiency was still less than optimal.

Figure 3:
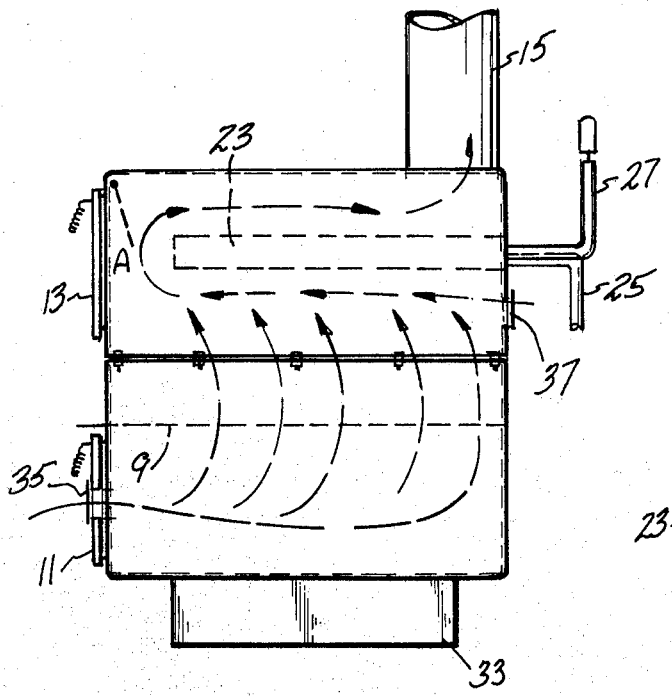
FIG. 3 is a side view, similar to FIGS. 1 and 2, of the boiler of the present invention.

In an effort to overcome this last problem, the boiler was further modified, as seen in FIG. 3, by sealing secondary air vent 31 on loading door 13. Secondary air is now controllably admitted through an adjustable sliding plate vent 37 in the rear wall of firebox 1, immediately below baffle member 17.

Careful study of this boiler reveals that the distribution of primary air is further improved, by the opposed relation of primary air vent 35 and secondary air vent 37, whereby the streams of air merge and flow together, and, more importantly, secondary combustion now occurs, as desired, along the under surface of the heat transfer member, whereby heat transfer to the flowing stream of water is maximized. Further energy is extracted from the hot gaseous products of the secondary combustion as they are drawn through gas passage area A and, thence, over the upper surface of the heat transfer member, before exiting firebox 1 through exhaust pipe 15.

While the present invention has been disclosed by reference to a preferred embodiment and developmental models, it should be readily apparent that various changes in components and arrangements may be made without departing from the spirit and contemplation of the invention which is intended to be limited in scope only by the appended claims.

We claim:

1. An improved coal-burning furnace comprising:

a. means defining a chamber, including a front wall member, a rear wall member, a top wall member, a bottom wall member, and a pair of side wall members;

b. baffle means dividing said chamber into upper and lower chamber portions, said chamber portions communicating proximate said front wall, said baffle means being a heat transfer member comprising means defining a continuous fluid flow channel for passage of a heat-absorbing fluid through said firebox, said channel defining means comprising a pair of parallel plates, a plurality of parallel channel wall members extending perpendicularly therebetween and a pair of parallel end walls, said channel wall members being alternately longitudinally offset, each contacting but one of said end walls;

c. a grate in said lower chamber portion;

d. first means in said front wall member for controllably admitting a stream of air into said lower chamber portion, below said grate;

e. second means in said rear wall member for controllably admitting a stream of air into said lower chamber portion, immediately below said baffle means; and f. exhaust means in said top wall, proximate said rear wall member;

g. said chamber-defining means comprising upper and lower furnace halves having mating, outwardly turned, flanges adapted to be joined by mechanical fasteners, with the flanged joint lying substantially along the horizontal median lines of said front, rear and side wall members, said grate being disposed in said lower furnace half and said baffle being disposed in said upper furnace half.

2. The invention of claim 1, wherein said baffle means extends forwardly from said rear wall and transversely from one to the other of said side wall members.

3. An improved coal-burning furnace comprising:

a. a right parallelspiped firebox consisting of upper and lower firebox halves having mating, outwardly turned flanges joined by mechanical fasteners, with the flanged joint lying substantially along the horizontal median lines of the walls thereof;

b. a grate, in said lower half of said firebox, adapted to support a bed of coal to be burned;

c. first air inlet means, in a first wall of said firebox, for controllably admitting a first stream of air into said firebox below said grate;

d. a heat transfer member, disposed (in said firebox,) above said grate, in said upper half of said firebox, and adapted to collect thereunder combustible gases from the primary combustion of coal on said grate, said heat transfer member comprising a pair of parallel plates, a plurality of parallel channel wall members extending perpendicularly therebetween, and a pair of parallel end walls, said channel wall members being alternately longitudinally offset, each contacting but one of said end walls;

e. second air inlet means in a second wall of said firebox, opposite said first wall, for admitting a second stream of air into said firebox, immediately below said heat exchange member, for burning of said combustible gases collected there; and f. exhaust means in said upper half of said firebox, above said heat transfer member, adapted to draw the burned gases over an upper surface of said heat exchange member before the same exit said firebox.

4. The invention of claim 3, wherein said heat transfer member extends forwardly from the rear wall of said firebox and transversely from side to side thereof.

* * * * *